US006565134B1

(12) United States Patent
Stuart et al.

(10) Patent No.: US 6,565,134 B1
(45) Date of Patent: May 20, 2003

(54) HANDLE WITH SIDE IMPACT COUNTERWEIGHT HAVING INSTALLATION POSITION

(75) Inventors: David R. Stuart, Middleville, MI (US); Michael Boorsma, Grandville, MI (US); Christian M Norton, Wixom, MI (US); David Bruce Lehmkuhl, Dearborn, MI (US); James Lee Salmon, Mariemont, OH (US)

(73) Assignee: ADAC Plastics, Inc., Grand Rapids, MI (US)

( * ) Notice: Subject to any disclaimer, the term of this patent is extended or adjusted under 35 U.S.C. 154(b) by 0 days.

(21) Appl. No.: 09/556,845

(22) Filed: Apr. 21, 2000

(51) Int. Cl.[7] ..... E05B 3/00

(52) U.S. Cl. ..... 292/336.3; 292/DIG. 22; 292/DIG. 65

(58) Field of Search ..... 292/336.2, 347, 292/DIG. 22, DIG. 65, DIG. 31, DIG. 23, 216

(56) References Cited

U.S. PATENT DOCUMENTS

| | | | | |
|---|---|---|---|---|
| 3,583,741 | A | | 6/1971 | Breitschwerdt et al. |
| 3,719,248 | A | | 3/1973 | Breitschwerdt et al. |
| 3,990,531 | A | | 11/1976 | Register |
| 4,536,021 | A | * | 8/1985 | Mochida |
| 5,092,642 | A | | 3/1992 | Lindmayer et al. |
| 5,308,130 | A | | 5/1994 | Lee |
| 5,431,462 | A | | 7/1995 | Lignell |
| 5,560,659 | A | | 10/1996 | Dault |
| 5,669,642 | A | | 9/1997 | Kang |
| 5,769,471 | A | | 6/1998 | Suzuki et al. |
| 6,007,122 | A | | 12/1999 | Linder et al. |
| 6,010,167 | A | | 1/2000 | Tanimoto et al. |
| 6,042,159 | A | | 3/2000 | Spitzley |
| 6,099,052 | A | | 8/2000 | Spitzley |

FOREIGN PATENT DOCUMENTS

| | | | |
|---|---|---|---|
| JP | 41020518 A | * | 8/1998 |
| JP | 2001132282 A | * | 5/1999 |
| JP | 2000145211 A | * | 5/2000 |

* cited by examiner

*Primary Examiner*—Anthony Knight
*Assistant Examiner*—Vishal Patel
(74) *Attorney, Agent, or Firm*—Young & Basile, P.C.

(57) ABSTRACT

A motor vehicle door handle assembly combining the use of a counterweight to preclude inadvertent opening movement of the door in a side impact scenario and the ability to install the handle assembly from outside of the vehicle by passing the handle assembly through an aperture in an outer skin of the door. The handle assembly includes a housing; a handle mounted for opening and closing movement on the housing; an actuator mechanism operative in response to opening movement of the handle to unlatch a latch mechanism of the door and allow opening of the door; and a counterweight. The counterweight is mounted on the housing for movement between an installation position within a profile of the housing, to facilitate installation of the handle assembly in a motor vehicle door by insertion of the handle assembly through an aperture in an outer skin, and an operative position in juxtaposition to the actuator mechanism in which it is operative in response to an impact against the side of the vehicle proximate the door handle assembly to resist movement of actuator mechanism in a door unlatching direction. Following passage of the handle assembly through the aperture in the door with the counterweight in its installation position, the handle member is moved relative to the housing to release the counterweight and allow it to be moved to its operative position under the biasing of the handle assembly return spring which normally acts to yieldably resist opening movement of the handle. The counterweight in its operative position pushes against the actuator mechanism but is free to move away from the actuator mechanism so as not to act to urge the actuator mechanism in a door unlatching direction in response to an impact against the side of the vehicle remote from the door handle assembly.

18 Claims, 6 Drawing Sheets

HANDLE WITH SIDE IMPACT COUNTERWEIGHT HAVING INSTALLATION POSITION

FIELD OF THE INVENTION

This invention relates to handle assemblies and more particularly to handle assemblies for controlling the latch mechanisms on motor vehicle doors.

BACKGROUND OF THE INVENTION

Vehicle doors typically include a latch mechanism for latching and unlatching the door to the vehicle body, a handle assembly positioned on the door and operative to control the latch mechanism, and a lock mechanism to selectively render the handle assembly effective or ineffective to operate the latch. It is imperative that side impact against the vehicle, resulting for example from a collision, not result in the inadvertent movement of the handle of the handle assembly to a latch release position with consequent movement of the latch to an unlatched position and consequent inadvertent opening of the door. This in general is not a problem when the door is locked since in this case the door handle is either precluded from movement by the lock mechanism or the door handle is allowed to freewheel to its unlatched position but this movement is ineffective to move the latch to its unlatched position. However, when the door is unlocked, as is most typically the case in an operating vehicle, side impact can easily result in inertial movement of the door handle to its unlatched position with consequent unlatching of the latch mechanism, consequent opening of the door, and consequent discharge of unbuckled vehicle passengers from the vehicle.

Various attempts have been made to prevent such inadvertent opening of the door in a side impact. One such attempt has involved the use of a counterweight which forms a part of the door handle assembly and which is incorporated in the actuator mechanism of the door handle assembly in such a way as to resist inadvertent door opening movement of the actuator mechanism in a side impact scenario. Such use of a counterweight in the door handle assembly to preclude inadvertent door opening has been generally effective. However, it is desirable in many installation situations to install the door handle assembly from outside of the vehicle by inserting the door handle assembly through an aperture in the outer skin of the vehicle door and, in this scenario, the counterweight, which typically projects beyond the profile of the housing of the door handle assembly, complicates and/or precludes installation of the door handle assembly through the aperture in the outer skin of the door and dictates the use of more complicated and more expensive installation techniques.

SUMMARY OF THE INVENTION

This invention is directed to an improved door handle assembly.

More specifically, this invention is directed to a vehicular door handle assembly that operates to preclude inadvertent opening of the door in the event of a side impact against the vehicle.

Yet more specifically, this invention is directed to a vehicular door handle assembly that operates-to preclude inadvertent opening of the door in the event of a side impact against the vehicle and which allows the insertion of the door handle assembly through an aperture in the outer skin of the door to simplify installation.

The door handle assembly of the invention is of the type adapted for installation in a motor vehicle door by inserting the handle assembly through an aperture in an outer skin of the door. The handle assembly includes a housing, a handle mounted for movement on the housing, an actuator mechanism operative in response to opening movement of the handle relative to the housing to unlatch a latch mechanism of the door to allow opening of the door, and a counterweight having an operative position in which it is operative in response to a vehicular side impact to resist movement of the handle assembly in a door unlatching direction.

According to the invention, the counterweight is movable between the operative position and an installation position generally within a profile of the housing. This arrangement facilitates movement of the handle assembly through the door aperture and allows the use of a counterweight mechanism in conjunction with installation of the door handle assembly through an aperture in the outer door skin.

According to a further feature of the invention, the handle assembly includes a latch mechanism maintaining the counterweight in its installation position; release means operative in response to movement of the handle relative to the housing to release the latch mechanism; and biasing means operative to move the counterweight from the installation position to the operative position in response to release of the latch mechanism. This arrangement allows the handle assembly to be inserted through the aperture in the door skin with the counterweight in its installation position whereafter the handle may be moved to release the counterweight for movement by the biasing means to its operative position.

According to a further feature of the invention, the actuator mechanism includes a lever mounted for pivotal movement on the housing about a pivot axis in response to opening movement of the handle and the counterweight is mounted for pivotal movement about the pivot axis between its installation and operative positions. This arrangement provides a compact and efficient arrangement for accommodating the opening movement of the actuator mechanism and the movement of the counterweight from its installation to its operative position.

According to a further feature of the invention, the lever comprises a bell crank lever having a first arm driven by the handle and a second arm connected to the latch mechanism of the door and the counterweight is positioned in its operative position against the second arm of the bell crank lever. With this arrangement the counterweight operates to resist movement of the bell crank in a door unlatching direction in response to a vehicle side impact.

According to a further feature of the invention, the counterweight in its operative position pushes against the actuator mechanism rather than being fixed for movement with the actuator mechanism. With this arrangement the counterweight may push against the actuator mechanism to resist opening movement of the handle assembly in response to an impact against the side of the vehicle proximate the handle assembly but is free to move away from the actuator mechanism in response to an impact against the side of the vehicle remote from the handle assembly so as not to act to urge the actuator mechanism in a door unlatching direction.

According to a further feature of the invention, the latch mechanism comprises a latch member on the housing engaging the counterweight with the counterweight in its installation position; the biasing means comprises a coil spring positioned on the pivot axis and urging the counterweight for pivotal movement toward its operative position; and the release means comprises a surface on the handle engaging a coacting surface on the counterweight in response to movement of the handle relative to the housing and operative to disengage the counterweight from the latch member and allow the coil spring to move the counterweight about the pivot axis to its operative position against the second arm of the bell crank lever.

The invention further provides a method of installing a door handle assembly in a motor vehicle door by inserting the handle assembly through an aperture in an outer skin of the door. The handle assembly is of the type including a housing, a handle mounted for movement on the housing, an actuator mechanism operative in response to opening movement of the handle relative to the housing to unlatch a latch mechanism of the door and allow opening of the door, and a counterweight having an operative position in which it is operative in response to a vehicle side impact to resist movement of the handle assembly in a door unlatching direction.

According to the invention methodology, the counterweight is mounted for movement between its operative position and an installation position generally within a profile of the housing; the handle assembly is inserted through the door aperture with the counterweight in its installation position; and the counterweight is thereafter moved to its operative position. This methodology allows the use of a counterweight mechanism in conjunction with an installation procedure wherein the handle assembly is inserted through an aperture in the outer skin of the door.

According to a further feature of the invention methodology, the handle assembly further includes a counterweight latch maintaining the counterweight in its installation position, release means operative in response to movement of the handle relative to the housing to release the counterweight latch, and biasing means operative to move the counterweight from the installation position to the operative position in response to the release of the counterweight, and the invention methodology further comprises installing the handle assembly through the aperture with the counterweight latch maintaining the counterweight in its installation position and thereafter moving the handle relative to the housing to release the counterweight latch and allow the biasing means to move the counterweight to its operative position. This methodology further facilitates the use of a counterweight door handle assembly in conjunction with an installation procedure involving insertion of the door handle assembly through an aperture in the outer skin of the door.

According to a further feature of the invention methodology, the actuator mechanism comprises a lever mounted for pivotal movement on the housing about a pivot axis in response to opening movement of the handle and the counterweight is mounted for pivotal movement about the pivot axis between its installation and operative positions, and the invention methodology further comprises pivoting the counterweight about the pivot axis from its installation position to its operative position following insertion of the handle assembly through the aperture and movement of the handle to release the counterweight latch. This specific methodology facilitates the movement of the counterweight between its installation position and its operative position.

According to a further feature of the invention methodology, the lever comprises a bell crank lever having a first arm driven by the handle and a second arm connected to the latch mechanism of the door and the counterweight is positioned in its operative position against the second arm of the bell crank lever whereby to resist movement of the bell crank lever in a door unlatching direction in response to a vehicular side impact.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
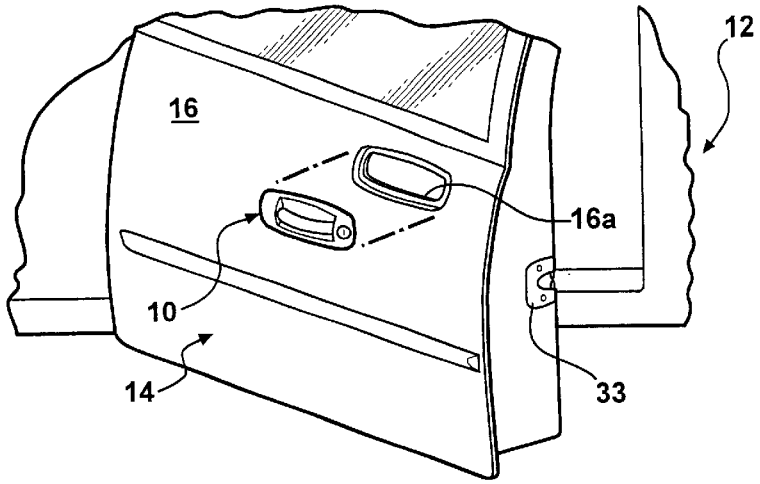
FIG. 1 is a fragmentary view of a motor vehicle schematically illustrating the installation of the door handle assembly in the motor vehicle door.

The handle assembly 10 of the invention is seen in FIG. 1 in association with a fragmentarily shown motor vehicle 12 including a door 14, an outer door skin 16, and an aperture 16*a* in the door skin for passage and mounting of the door handle assembly.

The door handle assembly of the invention (FIGS. 2–7) includes a housing 18, a handle 20, a pivot shaft 22, a bell crank lever 24, a counterweight 26, and a coil spring 28. All of the parts may be formed of any suitable material, such for example as a suitable plastic or suitable metallic material, and may be formed in any suitable forming operation.

Figure 8:
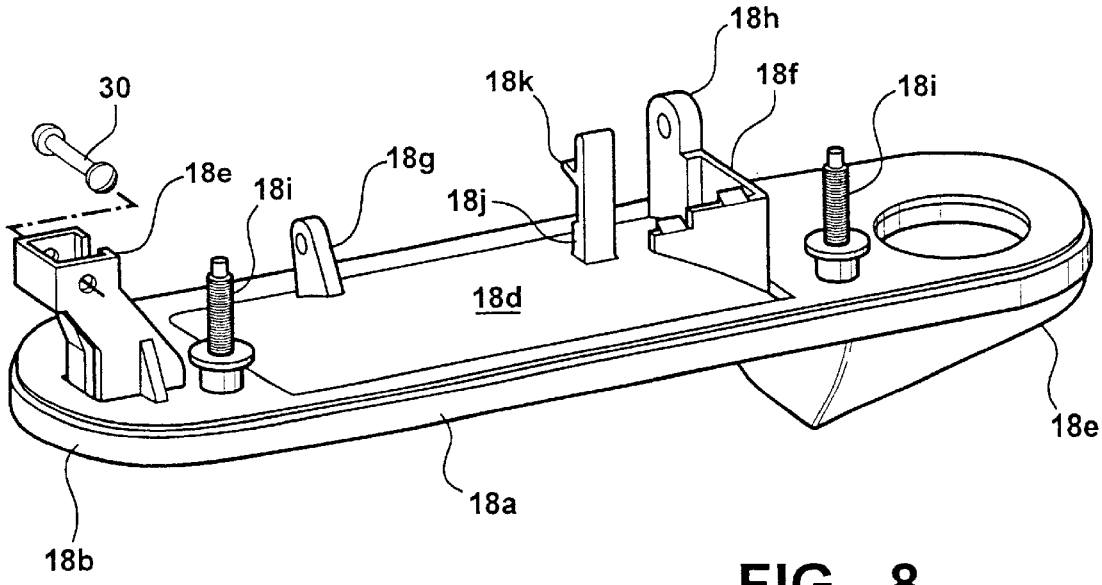
FIG. 8 is a perspective view of the housing of the handle assembly.
Figure 6:
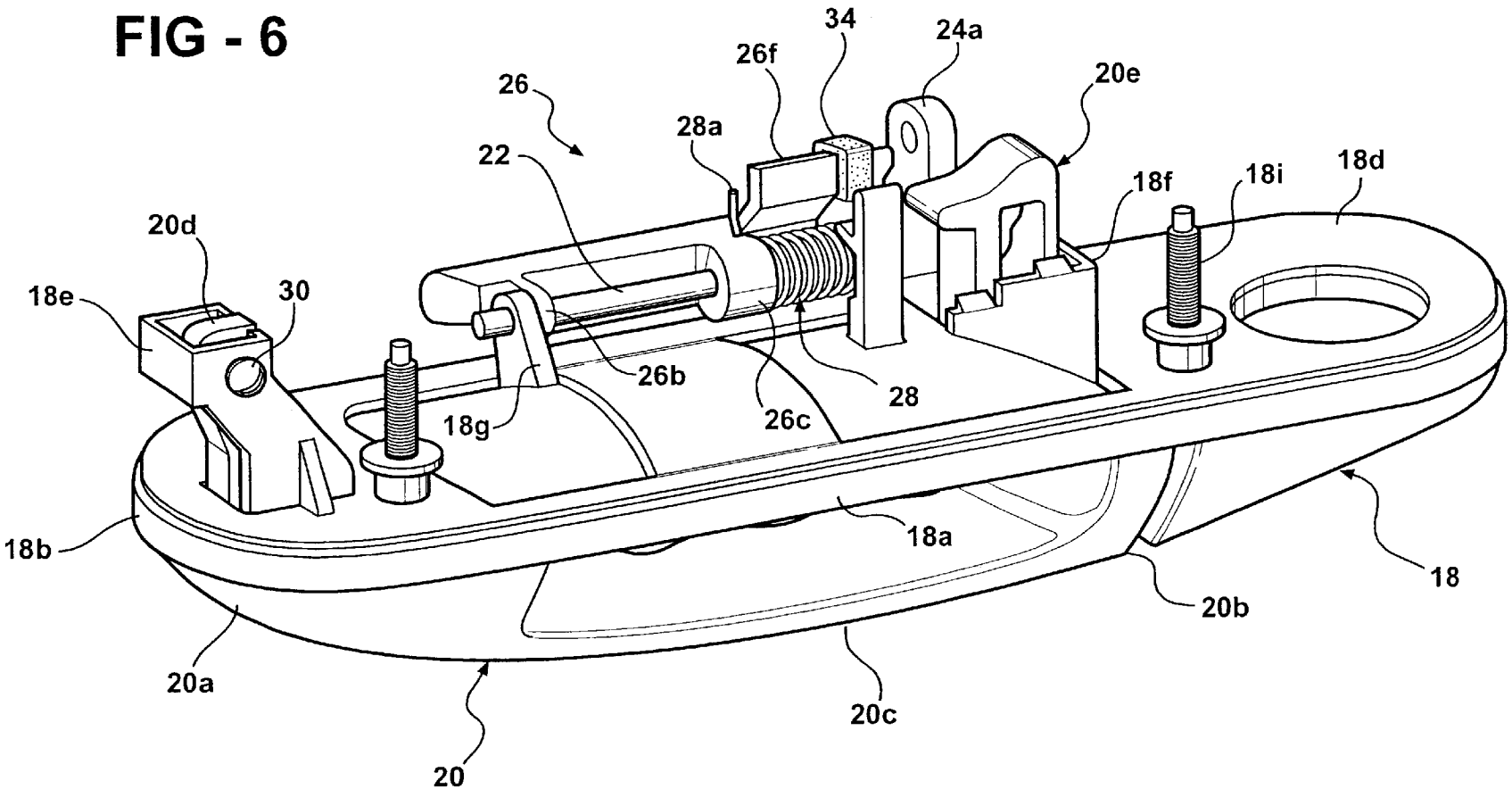
FIG. 6 is a perspective view of the handle assembly with the counterweight in an operative position.
Figure 7:
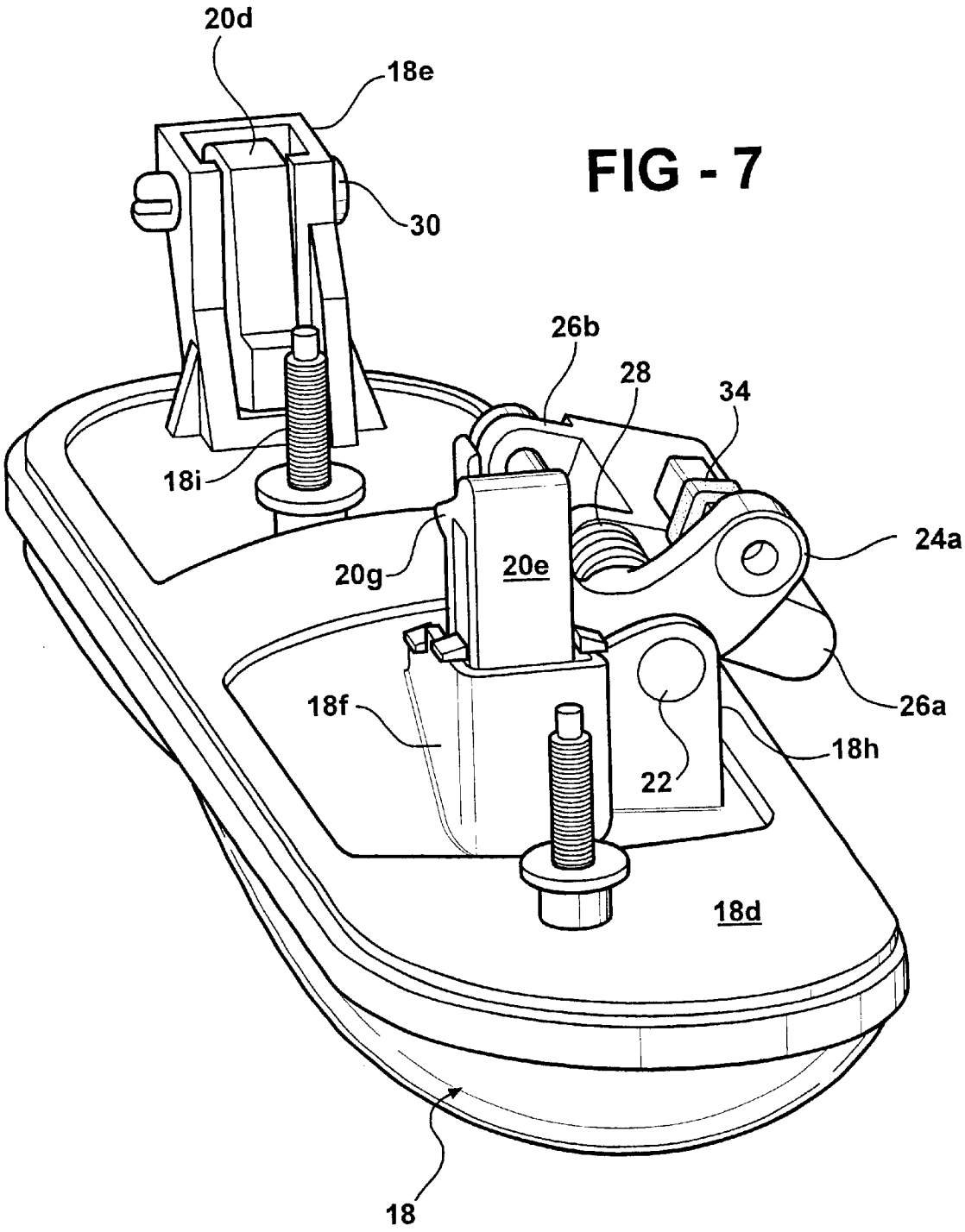
FIG. 7 is a further perspective view of the handle assembly with the counterweight in its operative position.

Housing 18 (FIG. 8) has a generally oblong oval configuration and includes a main body portion 18*a*, a front end 18*b*, a rear end 18*c*, an inner face 18*d*, a pivot structure 18*e* upstanding from inner face 18*d* proximate front end 18*b*, a guide structure 18*f* upstanding from inner face 18*d* proximate rear end 18*c*, a front lug 18*g*, a rear lug 18*h* formed integrally with guide structure 18*f*, front and rear fasteners 18*i* upstanding from the inner face 18*d*, and a resilient latch member 18*j* upstanding in cantilever fashion from inner face 18*d* and including a finger portion 18*k* proximate the free end of the latch member.

Figure 9:
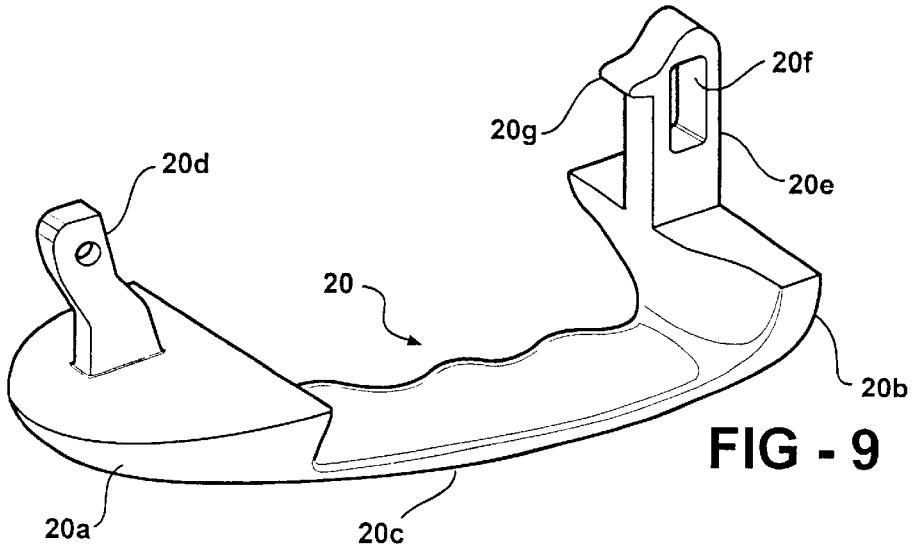
FIG. 9 is a perspective view of the handle of the handle assembly.

Handle 20 (FIG. 9) includes a front end 20*a*, a rear end 20*b*, a main body grasping portion 20*c* extending between front and rear ends 20*a*, 20*b*, a pivot arm 20*d* upstanding from front end 20*a*, and a tower or finger 20*e* upstanding from rear end 20*b* and including an aperture 20*f* and a tang 20*g*.

Pivot arm 20*d* extends upwardly through main body 18*a* of the housing for receipt in pivot structure 18*e*, whereby to pivotally mount the handle on the housing utilizing a suitable pivot pin 30, and tower structure 20*e* extends upwardly through main body portion 18*a* and through guide structure 18*f* to slidably mount the tower structure within the guide structure.

Pivot shaft 22 has a circular cross-sectional configuration and extends between housing lugs 18*g* and 18*h*.

Figure 10:
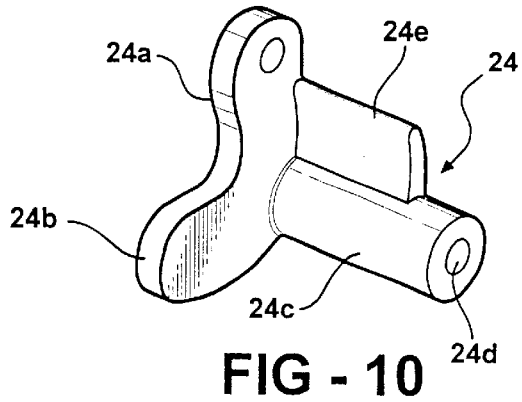
FIG. 10 is a perspective view of a bell crank lever utilized in the handle assembly.

Bell crank lever 24 (FIG. 10) includes a first arm portion 24*a*, a second arm portion 24*b*, a hub portion 24*c* defining a through bore 24*d*, and a flange portion 24*e*. Bell crank 24 is rotatably mounted on shaft 22 proximate housing flange 18*h* with pivot shaft 22 passing through through bore 24*d* and bell crank arm 24*b* positioned within aperture 20*f* of handle tower structure 20*e*. A suitable actuator rod 32 (FIG. 3) is connected at one end thereof to an aperture in bell crank arm 24*a* and at another end thereof to a door latch mechanism shown schematically at 33 in FIG. 1, whereby, in known manner, pivotal movement of the bell crank operates to latch and unlatch the latch mechanism 33.

Figure 11:
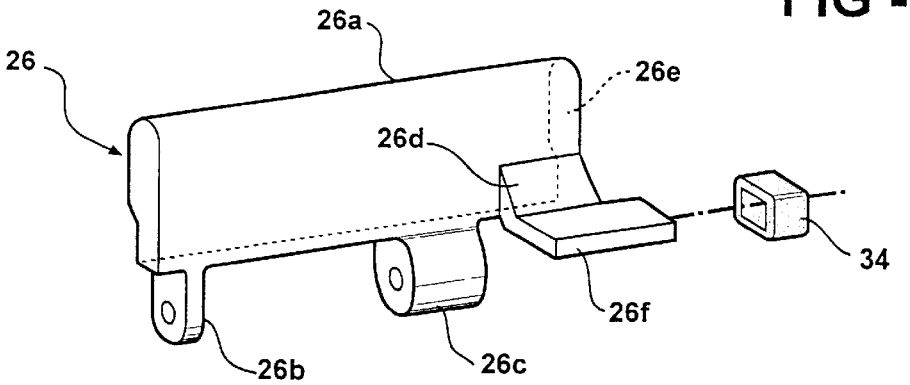
FIG. 11 is a perspective view of the counterweight utilized in the handle assembly.
Figure 12:
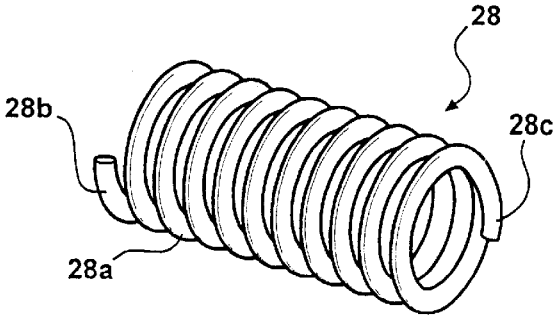
FIG. 12 is a perspective view of a spring utilized in the handle assembly.

Counterweight 26 (FIG. 11) includes a main body portion 26*a* having a generally rectangular cross section, front and rear lug portions 26*b* and 26*c*, and a tang portion 26*d* projecting laterally from main body portion 26*a* proximate the rear face 26*e* of the counterweight. Counterweight 26 is rotatably mounted on pivot shaft 22 between housing lugs 18*g* and 18*h* utilizing lugs 26*b*, 26*c*. Counterweight 26 is positioned on shaft 22 forwardly of bell crank 24 with tang 26*d* positioned for latching coaction with the latch finger portion 18*k* of latch member 18*j*. A tubular cap 34 is fitted over the free rear end 26*f* of tang 26*d* and overlyingly engages the tang 20*g* of the handle tower structure.

Coil spring 28 includes a main body portion 28*a*, a free front end portion 28*b*, and a free rear end portion 28*c*. Spring 28 is mounted on pivot shaft 22 between the rear lug 26*c* of the counterweight and the front end of the hub 24*c* of the bell crank lever with free front end 28*b* bearing against the underside of the main body portion of counterweight 26 and free rear end portion 28*c* bearing against an adjacent surface of the housing 18. Spring 28 thus provides a biasing force tending to rotate counterweight 26 about the axis of shaft 22 and further, in known manner, provides the return spring for the door handle assembly.

Figure 2:
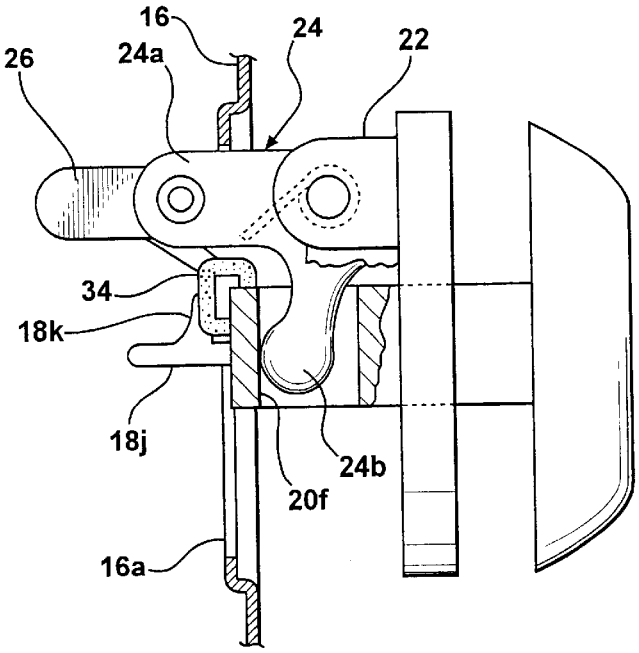
FIG. 2 is a view showing the installation of the door handle assembly by passing the door handle assembly through an aperture in the vehicle door.
Figure 4:
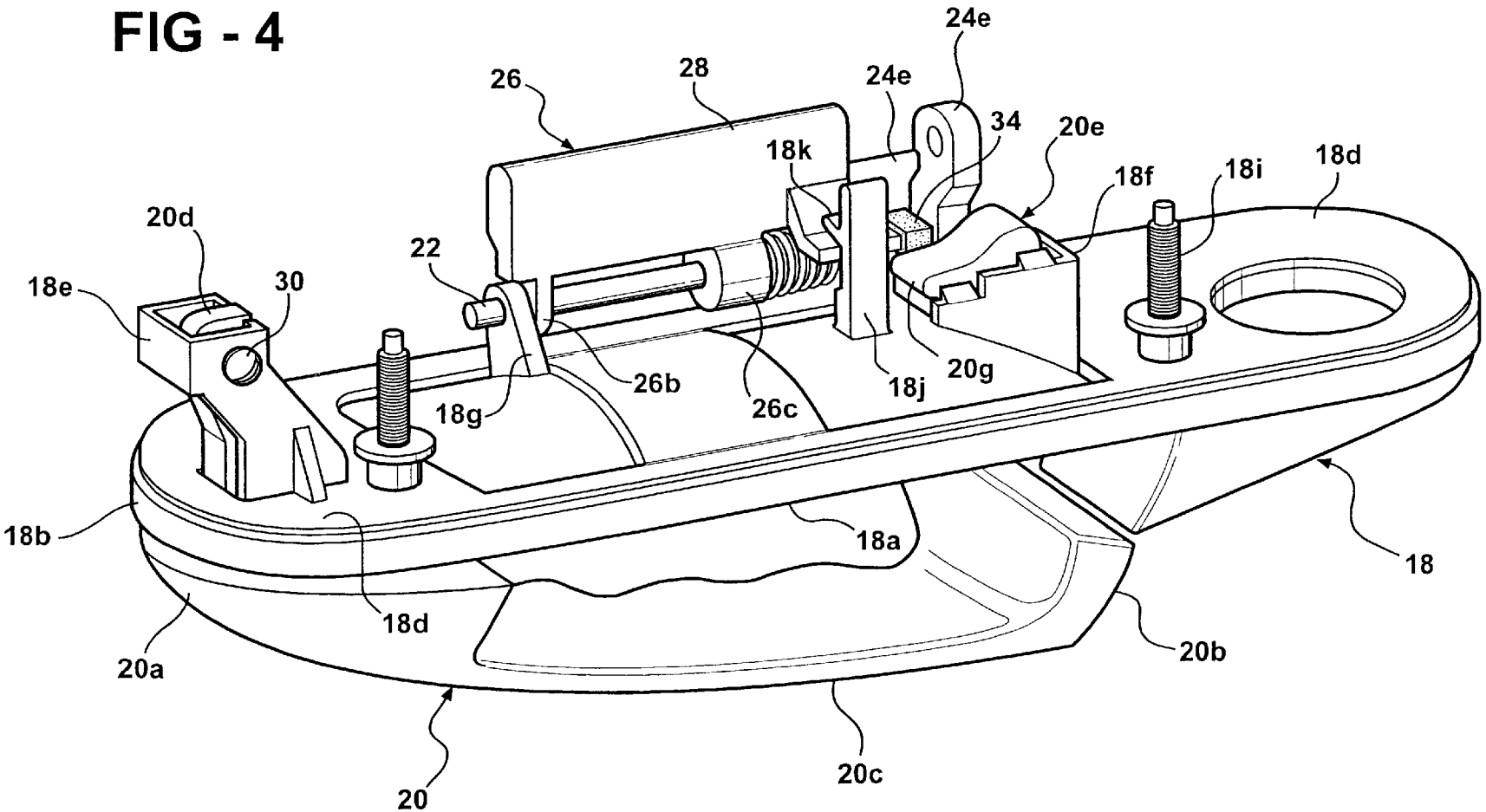
FIG. 4 is a perspective view showing the handle assembly with a counterweight in an installation position.
Figure 5:
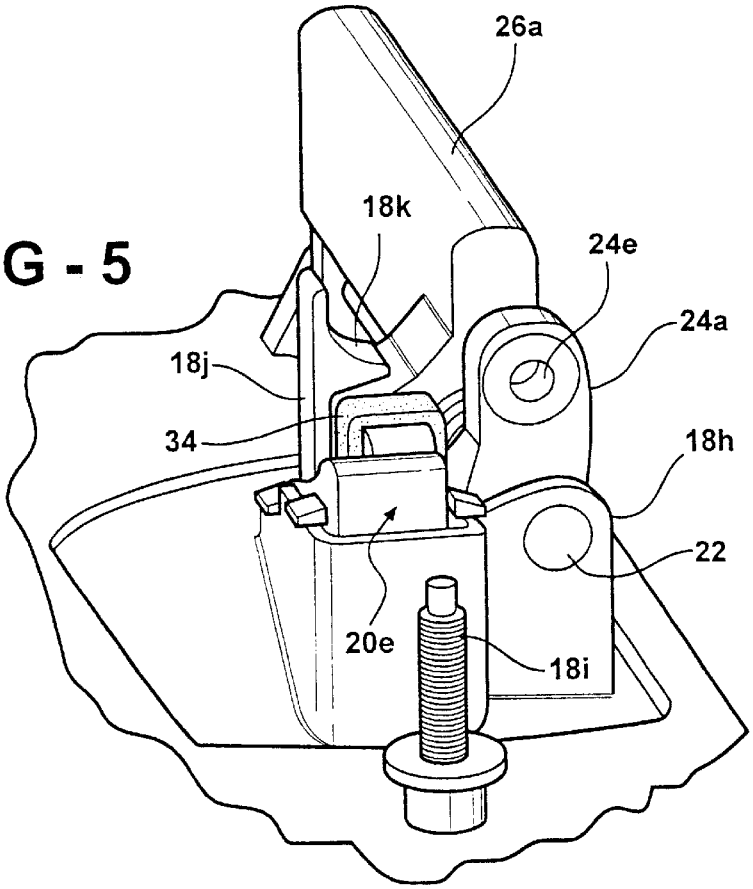
FIG. 5 is a further perspective view of the handle assembly with the counterweight in the installation position.

Preparatory to installing the door handle assembly in door 14, counterweight 26 is positioned in the installation position seen in FIGS. 2, 4, and 5. In this position of the counterweight, the handle is pivoted to an open or unlatching position whereby to pivot the bell crank lever to an unlatching position; the tang 20*g* of the handle tower structure immediately underlies the cap 34 positioned on the free end 26*f* of the tang 26*d* of the counterweight; the tang 26*d* of the counterweight is positioned beneath the finger portion 18*k* of the latch member 18*j* to preclude movement of the counterweight to its operative position; and spring 28 is loaded so as to exert a force via spring end 28*b* against the counterweight attempting to move the counterweight about the axis of pivot shaft 22 to its operative position.

Figure 3:
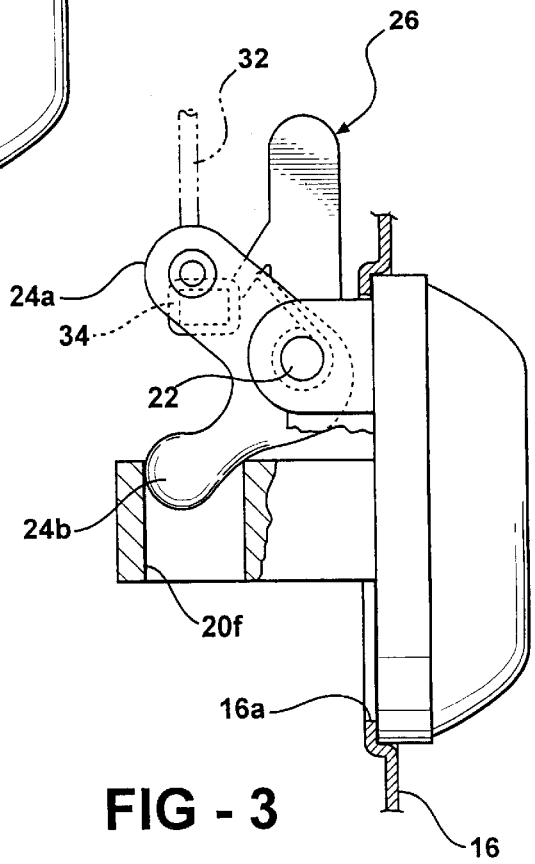
FIG. 3 is a view showing the completed installation of the door handle assembly in the vehicle door.

It will be seen that the counterweight in its installation position projects substantially forwardly from the main body of the housing and is within the forward profile of the housing. Accordingly, as seen in FIGS. 2 and 3, the handle assembly may be mounted on the door by passing the handle assembly through the aperture 16*a* in the outer skin 16 of the door to position the main body 18*a* of the housing within the aperture 16*a* and position the operating or actuating mechanisms of the door handle assembly, including the counterweight 26, within the interior of the door, whereafter the handle may be pivoted inwardly about the axis of pin 30 to move tower structure 20*e* upwardly within guide portion 18*f* of the housing. This movement of the handle in a closing or latching direction engages bell crank lever arm portion 24*b* and pivots the bell crank lever about the axis of pivot shaft 22 from the latch position seen in FIG. 2 to the unlatch position seen in FIG. 3 in which the counterweight extends beyond the forward profile of the housing.

At the same time, the tang 20*g* of the tower structure 20*e* bears against cap 34 and disengages tang 26*d* from the finger portion 18*k* of latch member 18*j* whereupon loaded spring 28 operates to rotate the counterweight about the axis of pivot shaft 22 to the operative position of the counterweight seen in FIG. 3. In this position, cap 34 bears against the flange portion 24*e* of the bell crank lever so that any attempt of the bell crank lever to rotate about the axis of shaft 22 in a door unlatching direction in response to an impact against the side of the vehicle proximate the door handle assembly is effectively resisted by the pushing action of the counterweight against the bell crank lever, whereby to preclude inadvertent unlatching movement of the door handle assembly in a proximate side impact scenario. Further, since the counterweight merely pushes against the bell crank lever, the counterweight is free to move away from the bell crank lever in response to an impact against the side of the vehicle remote from the door handle assembly so as not to act to urge the bell crank lever in a door unlatching direction in a remote side impact scenario.

It will be understood that, following positioning of the door handle assembly within the aperture 16*a*, the handle assembly is suitably fixedly secured to the door utilizing fasteners 18*i* and actuator rod 32 is connected to the arm portion 24*a* of bell crank 24 to operatively connect the handle assembly to the door latch assembly so that opening movement of the handle 20 has the effect of unlatching the door latch to allow opening of the door.

The invention door handle assembly will be seen to allow the utilization of a counterweighted door handle assembly in conjunction with an installation procedure wherein the handle assembly is installed on the door by passing the handle assembly through an aperture in the outer skin of the door, thereby combining the effectiveness of the counterweight arrangement in precluding inadvertent unlatching of the door in a side impact scenario with the simplicity and cost efficiencies of installation through an aperture in the outer skin of the door.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A door handle assembly adapted for installation in a motor vehicle door by inserting the handle assembly forwardly through an aperture in an outer skin of the door, the handle assembly comprising a housing, a handle mounted for movement on the housing, an actuator mechanism operative in response to opening movement of the handle relative to the housing to unlatch a latch mechanism of the door to allow opening of the door, and a counterweight having an operative position in which it is operative in response to a vehicular side impact to resist movement of the handle assembly in a door unlatching direction, characterized in that:

the housing has a generally planar elongated configuration and includes outer end edges defining the outer end limits of the housing;

the counterweight in its operative position extends beyond a forward profile of the outer end edges of the housing; and the counterweight is mounted on the housing for movement between the operative position and an installation position generally within the forward profile of the outer end edges of the housing whereby to facilitate movement of the handle assembly through the door aperture.

2. A door handle assembly according to claim 1 wherein the counterweight in its operative position pushes against the actuator mechanism rather than being fixed for movement with the actuator mechanism whereby the counterweight may push against the actuator mechanism to resist opening movement of the handle assembly in response to an impact against a side of the vehicle proximate the handle assembly but is free to move away from the actuator mechanism in response to an impact against a side of the vehicle remote from the handle assembly so as not to act to urge the actuator mechanism in the door unlatching direction.

3. A door handle assembly according to claim 1 wherein the counterweight is movable from its installation position to its operative position in response to movement of the handle on the housing.

4. A door handle assembly according claim 3 wherein:

the handle is mounted on the housing for movement between a latched position and an unlatched position;

the counterweight is maintained in its installation position with the handle in its unlatched position; and the counterweight is moved to its operative position in response to movement of the handle to its latched position.

5. A door handle assembly adapted for installation in a motor vehicle door by inserting the handle assembly through an aperture in an outer skin of the door, the handle assembly comprising a housing, a handle mounted for movement on the housing, an actuator mechanism operative in response to opening movement of the handle relative to the housing to unlatch a latch mechanism of the door to allow opening of the door, and a counterweight having an operative position in which it is operative in response to a vehicular side impact to resist movement of the handle assembly in a door unlatching direction, characterized in that:

the counterweight is moveable between the operative position and an installation position generally within a profile of the housing whereby to facilitate movement of the handle assembly through the door aperture; and the handle assembly includes a counterweight latch mechanism maintaining the counterweight in its installation position, release means operative in response to movement of the handle relative to the housing to release the counterweight latch mechanism, and biasing means operative to move the counterweight from the installation position to the operative position in response to release of the counterweight latch mechanism.

6. A door handle assembly according to claim 5 wherein:

the actuator mechanism comprises a lever mounted for pivotal movement on the housing about a pivot axis in response to opening movement of the handle; and the counterweight is mounted for pivotal movement about the pivot axis between its installation and operative positions.

7. A door handle assembly according to claim 6 wherein:

the lever comprises a bell crank lever having a first arm driven by the handle and a second arm connected to the latch mechanism of the door; and the counterweight is positioned in its operative position against the second arm of the bell crank lever whereby to resist movement of the bell crank lever in a door unlatching direction in response to an impact against the side of the vehicle proximate the door handle assembly.

8. A door handle assembly according to claim 7 wherein the counterweight in its operative position pushes against the second arm of the bell crank lever but is free to move away from the bell crank lever so as not to act to urge the bell crank lever in a door unlatching direction in response to an impact against a side of the vehicle remote from the door handle assembly.

9. A door handle assembly according to claim 7 wherein:

the counterweight latch mechanism comprises a latch member on the housing engaging the counterweight with the counterweight in its installation position;

the biasing means comprises a coil spring positioned on the pivot axis and urging the counterweight for pivotal movement toward its operative position; and the release means comprises a surface on the handle engaging a coacting surface on the counterweight in response to movement of the handle relative to the housing and operative to disengage the counterweight from the counterweight latch member and allow the coil spring to move the counterweight about the pivot axis to its operative position against the second arm of the bell crank lever.

10. A motor vehicle door handle assembly comprising:

a housing;

a handle mounted for opening and closing movement on the housing;

an actuator mechanism operative in response to opening movement of the handle to unlatch a latch mechanism of the door and allow opening of the door;

a counterweight mounted on the housing for movement between an installation position generally within a forward profile of the housing, to facilitate installation of the handle assembly in a motor vehicle door by insertion of the handle assembly through an aperture in an outer skin of the door, and an operative position in juxtaposition to the actuator mechanism in which it is operative in response to a vehicle side impact to resist movement of the actuator mechanism in a door unlatching direction;

the actuating mechanism including a lever mounted for pivotal movement about a pivot axis in response to movement of the handle on the housing;

the counterweight being mounted for pivotal movement on the pivot axis;

the lever comprising a bell crank lever having a first arm driven by the handle and a second arm connected to the latch mechanism of the door whereby opening movement of the handle unlatches the door; and the handle assembly further including a counterweight latch on the handle releasably maintaining the counterweight in its installation position and biasing means operative to urge the counterweight toward its operative position upon release of the counterweight latch.

11. A motor vehicle door handle assembly according to claim 10 wherein;

the counterweight latch is released in response to movement of the handle relative to the housing.

12. A motor vehicle door handle door assembly according to claim 11 wherein;

the bell crank lever and counterweight are mounted on a pivot shaft defining the pivot axis;

the biasing means comprises a coil spring mounted on the pivot shaft and engaging the counterweight to urge the counterweight toward its operative position; and a surface on the handle engages a coacting surface on the counterweight in response to movement of the handle relative to the housing to disengage the counterweight from the counterweight latch and allow the spring to move the counterweight to its operative position.

13. A method of installing a door handle assembly in a motor vehicle door by inserting the handle assembly forwardly through an aperture in an outer skin of the door, the handle assembly comprising a housing having a generally planar elongated configuration and including outer end edges defining the outer end limits of the housing, a handle mounted for movement on the housing, an actuator mechanism operative in response to opening movement of the handle relative to the housing to unlatch a latch mechanism of the door and allow opening of the door, and a counterweight having an operative position extending beyond a forward profile of the outer end edges of the housing in which it is operative in response to a vehicle side impact to resist movement of the handle assembly in a door unlatching direction, the method comprising:

mounting the counterweight for movement between its operative position and an installation position generally within the forward profile of the outer end edges of the housing;

inserting the handle assembly forwardly through the door aperture with the counterweight in its installation position; and thereafter moving the counterweight to its operative position.

14. A method of installing a door handle assembly in a motor vehicle door by inserting the handle assembly through an aperture in an outer skin of the door, the handle assembly comprising a housing, a handle mounted for movement on the housing, an actuator mechanism operative in response to opening movement of the handle relative to the housing to unlatch a latch mechanism of the door and allow opening of the door, a counterweight mounted for movement between an operative position in which it is operative in response to a vehicle side impact to resist movement of the handle assembly in a door unlatching direction and an installation position generally within a profile of the housing, a counterweight latch maintaining the counterweight in its installation position, release means operative in response to movement of the handle relative to the housing to release the counterweight latch, and biasing means operative to move the counterweight from the installation position to the operative position in response to release of the counterweight latch; the method comprising installing the handle assembly through the aperture with the counterweight latch maintaining the counterweight in its installation position and thereafter moving the handle relative to the housing to release the counterweight latch and allow the biasing means to move the counterweight to its operative position.

15. A method according to claim 14 wherein:

the actuator mechanism comprises a lever mounted for pivotal movement on the housing about a pivot axis in response to opening movement of the handle and the counterweight is mounted for pivotal movement about the pivot axis between its installation and operative positions; and the method comprises pivoting the counterweight about the pivot axis from its installation position to its operative position following insertion of the handle assembly through the aperture and movement of the handle to release the counterweight latch.

16. A method according to claim 15 wherein:

the lever comprises a bell crank lever having a first arm driven by the handle and a second arm connected to the latch mechanism of the door; and the counterweight in its operative position pushes against the second arm of the bell crank lever, whereby to resist movement of the bell crank lever in a door unlatching direction in response to an impact against a side of the vehicle proximate the door handle assembly but is free to move away from the second arm of the bell crank lever so as not to urge the bell crank lever in a door unlatching direction in response to an impact against a side of the vehicle remote from the door handle assembly.

17. A motor vehicle door handle assembly comprising:

a housing having a generally planar elongated configuration and including outer end edges defining the outer end limits of the housing;

a handle mounted for opening and closing movement on the housing;

an actuator mechanism operative in response to opening movement of the handle to unlatch a latch mechanism of the door and allow opening of the door; and a counterweight mounted on the housing for movement between an installation position generally within a forward profile of the outer end edges of the housing, to facilitate installation of the handle assembly in a motor vehicle door by insertion of the handle assembly forwardly through an aperture in an outer skin of the door, and an operative position beyond the forward profile of the outer end edges of the housing and in juxtaposition to the actuator mechanism in which it is operative in response to a vehicle side impact to resist movement of the actuator mechanism in a door unlatching direction.

18. A motor vehicle door handle assembly according to claim 17 wherein;

the actuating mechanism includes a lever mounted for pivotal movement about a pivot axis in response to movement of the handle on the housing; and the counterweight is mounted for pivotal movement on the pivot axis.

* * * * *